US007121332B2

(12) United States Patent
Förster et al.

(10) Patent No.: US 7,121,332 B2
(45) Date of Patent: Oct. 17, 2006

(54) HEAT EXCHANGER

(75) Inventors: Uwe Förster, Ludwigsburg (DE); Kurt Molt, Bietigheim-Bissingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/513,582

(22) PCT Filed: Nov. 3, 2003

(86) PCT No.: PCT/EP03/12227

§ 371 (c)(1),
(2), (4) Date: Nov. 5, 2004

(87) PCT Pub. No.: WO2004/048875

PCT Pub. Date: Jun. 10, 2004

(65) Prior Publication Data

US 2005/0230093 A1 Oct. 20, 2005

(30) Foreign Application Priority Data

Nov. 27, 2002 (DE) ..... 102 55 487

(51) Int. Cl.
*F28F 9/22* (2006.01)
*F28B 1/06* (2006.01)

(52) U.S. Cl. ..... 165/174; 165/110

(58) Field of Classification Search ..... 165/110, 165/173, 175, 176
See application file for complete search history.

(56) References Cited

U.S. PATENT DOCUMENTS

| | | | | |
|---|---|---|---|---|
| 5,172,761 | A | 12/1992 | Lyon | |
| 5,190,101 | A | 3/1993 | Jalilevand et al. | |
| 5,226,490 | A | 7/1993 | Ryan et al. | |
| 5,329,990 | A * | 7/1994 | Chigira | 165/153 |
| 5,947,196 | A * | 9/1999 | Halm et al. | 165/173 |
| 6,155,340 | A * | 12/2000 | Folkedal et al. | 165/175 |
| 6,272,881 | B1 * | 8/2001 | Kuroyanagi et al. | 62/525 |
| 6,446,713 | B1 * | 9/2002 | Insalaco | 165/173 |
| 6,540,016 | B1 * | 4/2003 | Baldantoni | 165/173 |
| 6,640,887 | B1 * | 11/2003 | Abell et al. | 165/175 |
| 6,732,789 | B1 * | 5/2004 | Jang | 165/110 |
| 6,745,827 | B1 * | 6/2004 | Lee et al. | 165/144 |
| 6,896,044 | B1 * | 5/2005 | Kato | 165/175 |
| 2001/0040027 | A1 * | 11/2001 | Tooyama et al. | 165/153 |
| 2002/0066553 | A1 * | 6/2002 | Fischer et al. | 165/174 |
| 2003/0155109 | A1 * | 8/2003 | Kawakubo et al. | 165/173 |
| 2004/0182558 | A1 * | 9/2004 | Watanabe et al. | 165/173 |
| 2005/0205244 | A1 * | 9/2005 | Kaspar | 165/110 |
| 2005/0211420 | A1 * | 9/2005 | Takano | 165/110 |

FOREIGN PATENT DOCUMENTS

| | | | |
|---|---|---|---|
| DE | 199 06 289 | A1 | 8/1999 |
| DE | 100 56 074 | A1 | 5/2002 |
| EP | 0 947 792 | A2 | 10/1999 |
| FR | 2 793 015 | A1 | 11/2000 |
| JP | 7-318288 | A | 12/1995 |
| JP | 9-196594 | A | 7/1997 |
| WO | WO 98/51983 | A1 | 11/1998 |

* cited by examiner

*Primary Examiner*—Allen J. Flanigan
(74) *Attorney, Agent, or Firm*—Foley & Lardner LLP

(57) ABSTRACT

Heat exchanger (1), in particular a gas condenser for a $CO_2$ coolant, comprising at least one two-part collector chamber (4) consisting of a base (3) and a cover (5) and a heat exchanger network consisting of flat tubes (2) and corrugated ribs.

24 Claims, 5 Drawing Sheets

HEAT EXCHANGER

Figure 1:
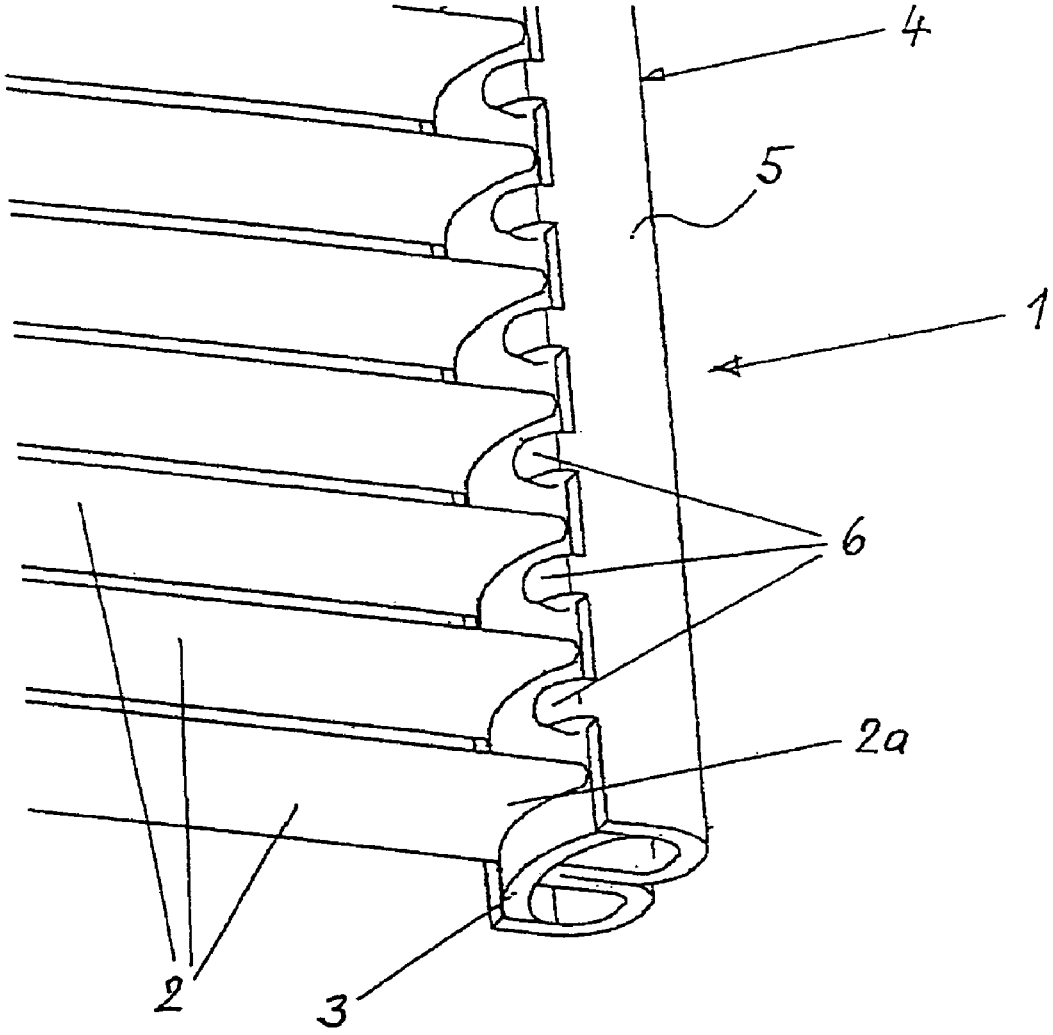

The invention relates to a heat exchanger, in particular a gas cooler for CO2 as coolant.

Heat exchangers for air-conditioning systems with R134a as coolant consist of a heat exchanger network comprising flat tubes and of header tubes arranged on both sides of the network and possessing a circular cross section. Designs of this type had sufficient strength for the pressures occurring in a condenser. Where modern coolants, such as, for example, $CO_2$, are concerned, however, considerably higher pressures arise which can no longer be controlled by means of the conventional heat exchanger types of construction. Extruded header tubes with an increased wall thickness were therefore proposed in WO 98/51983, a header tube consisting of four circular flow ducts arranged next to one another. The production of such an extruded header tube is cost-intensive on account of the dies required for this purpose.

Another type of header tube was proposed in DE-A-199 06 289, a header tube being constructed from extruded parts and having two circular flow ducts for the coolant $CO_2$. Even in this type of construction, at least part of the header tube has to be produced by extrusion, and this has an adverse effect on the production costs of the heat exchanger (gas cooler).

The object of the present invention, therefore, is to provide a heat exchanger of the type initially mentioned with a cost-effective and pressure-resistant header tube.

Accordingly, the header tube is produced in two parts, that is to say from a bottom and from a cover which consists of a bent sheet metal strip in the shape of, for example, a W and which forms with the bottom two approximately circular flow ducts. The cover and the bottom and also the flat tubes inserted into the bottom are soldered to one another in a pressuretight manner. A longitudinal partition of the cover/bottom acts in this case as a tie rod since it is soldered to the bottom/cover. This type of construction of the header box is cost-effective, since there are no costly tools required for bending or folding the cover and the bottom.

Advantageous refinements of the invention may be gathered from further embodiments. For example, the edges of the cover which engage over the bottom have individual tabs or brackets which engage over the bottom in its edge region and consequently bring about a prefixing of the bottom and cover before the soldering process. There is therefore no longer any need for an additional soldering device in order to solder the heat exchanger. Increased pressure stability is achieved when the bottom is of concave design. It is advantageous, furthermore, that the middle web or the longitudinal partition has in the region of the flat tube ends indentations which allow an outflow of the coolant from the flat tubes and an overflow of the coolant from one longitudinal duct into the other. This affords diverse possibilities for routing the flow of the coolant, in particular in conjunction with partitions running transversely. It is also advantageous if a step as bearing means for the bottom is provided on the inside of the cover edges. A defined bearing surface is thereby obtained during the assembly of the cover and bottom. Finally, the number of longitudinal ducts of the header box may be multiplied by the cross-sectional shape of the cover being a WW-shape or a multiple-W shape. In each case two additional longitudinal ducts are thereby provided, that is to say a larger volume for the coolant is made available, as required. It may likewise be advantageous in this case to provide two or more flat tube rows instead of only one flat tube row.

Figure 2:
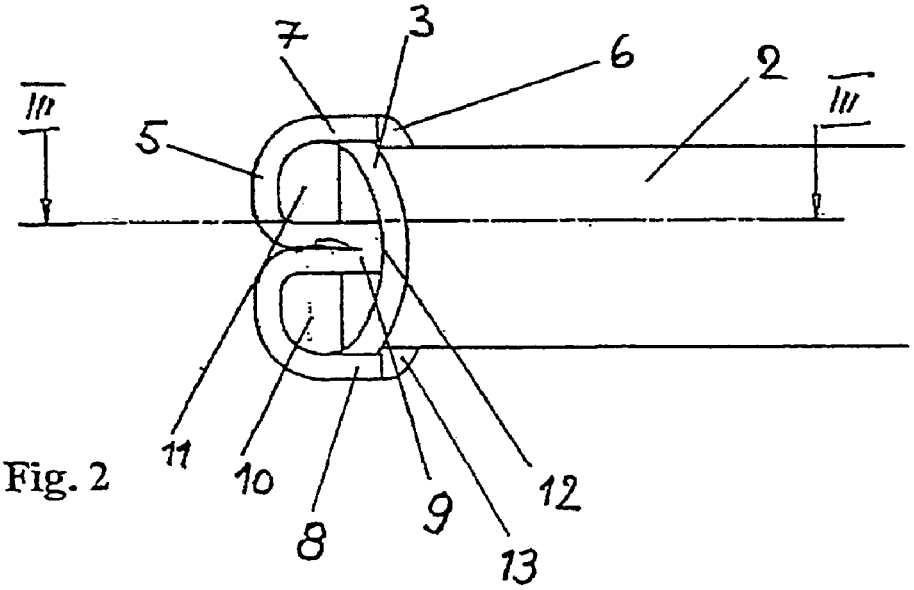
Figure 3:
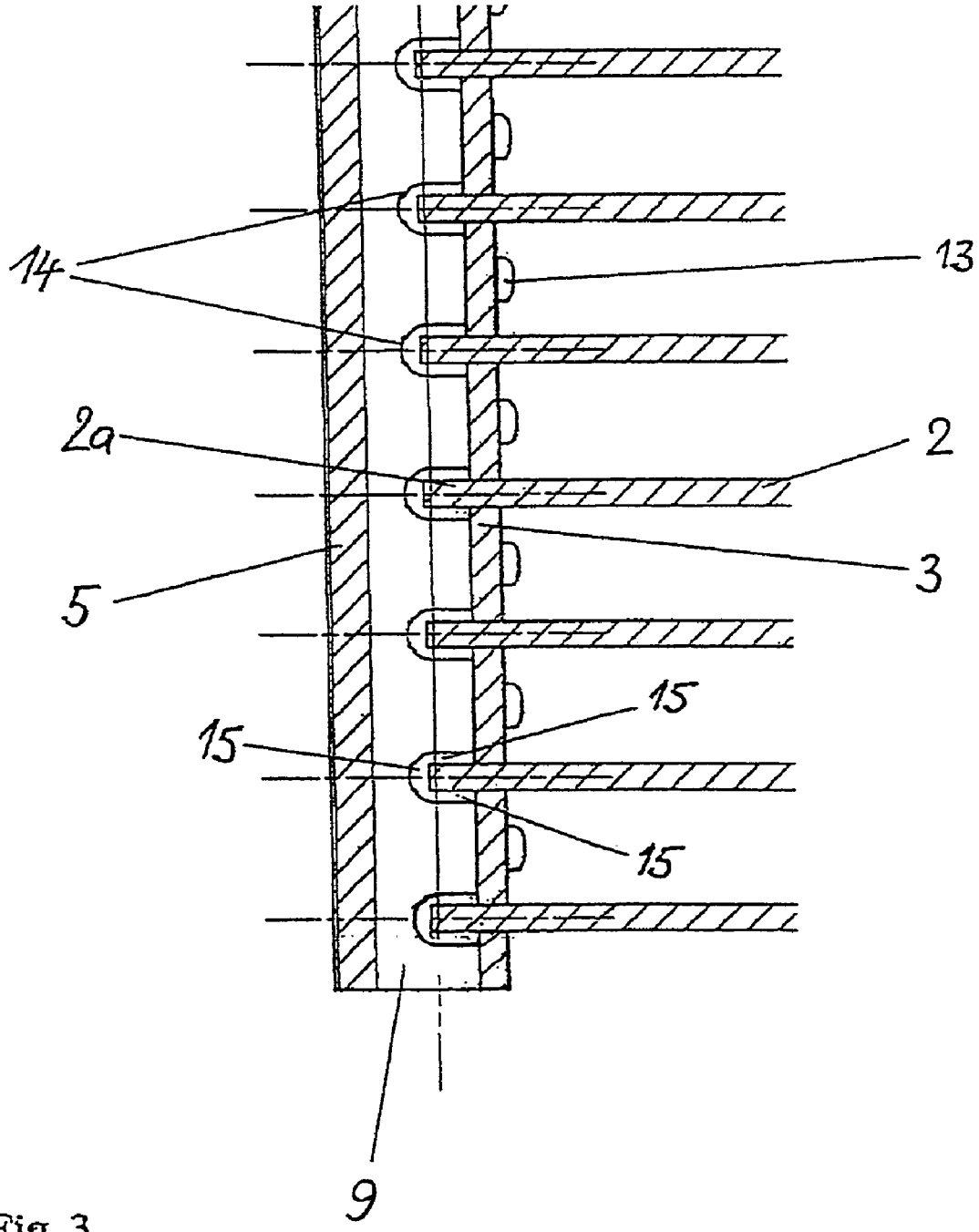
Figure 4:
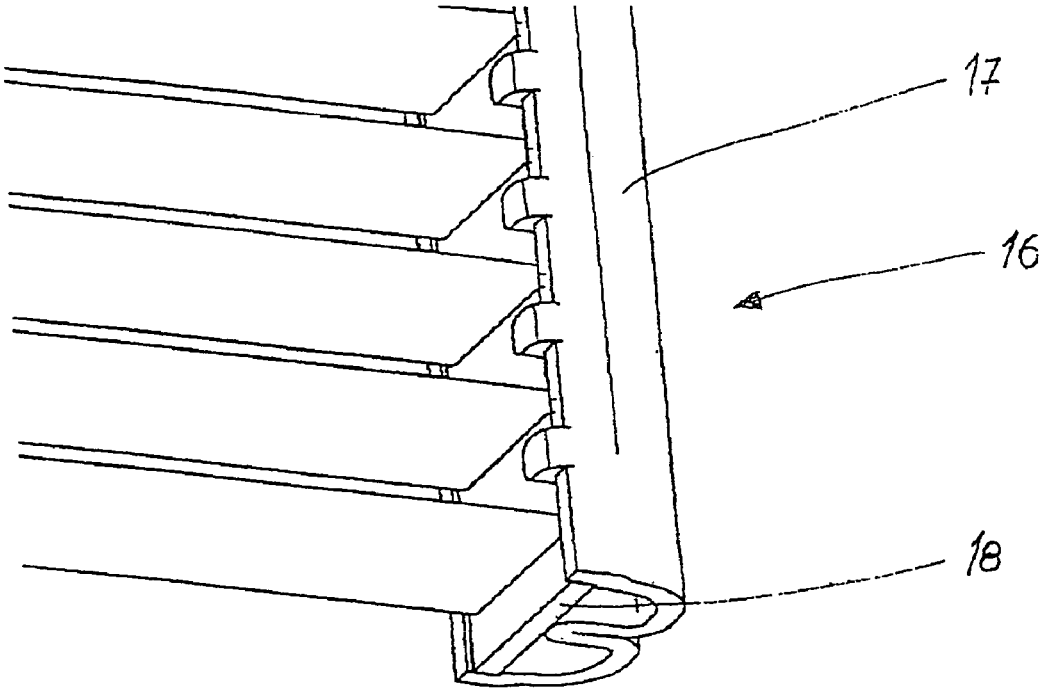
Figure 5:
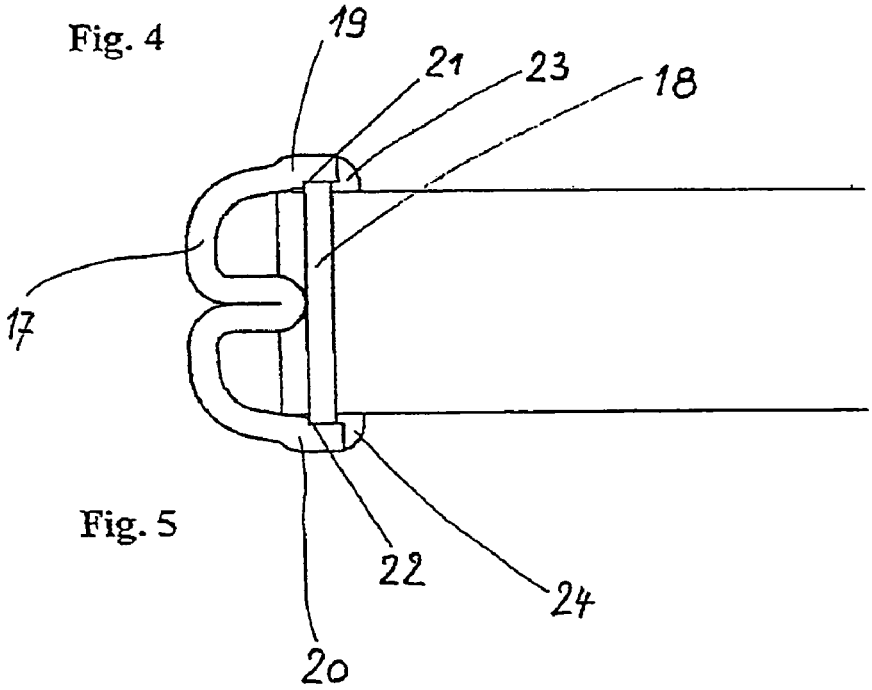
Figure 6:
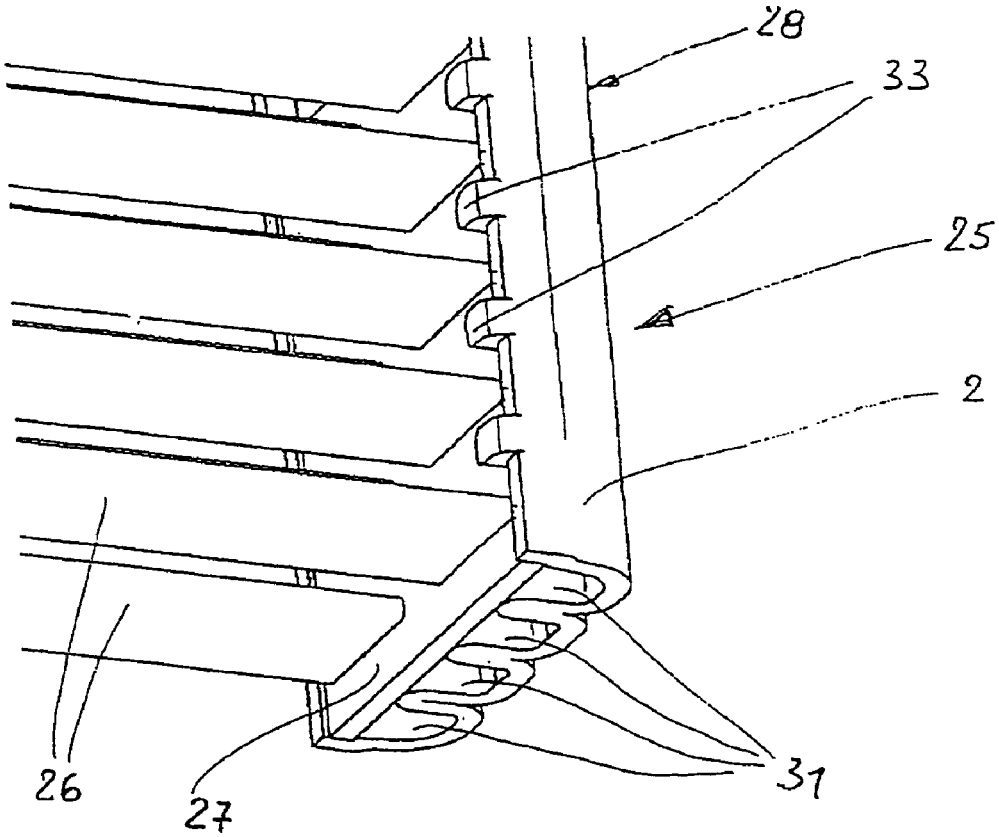
Figure 7:
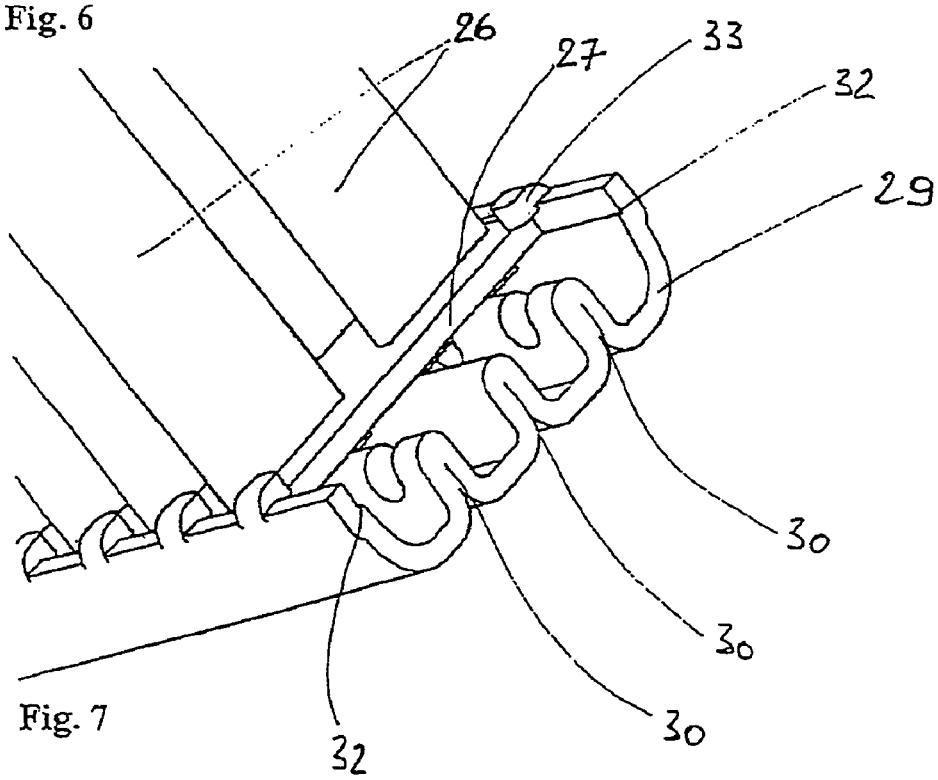

Exemplary embodiments of the invention are illustrated in the drawings and are described in more detail below. In the drawings:

FIG. 1 shows a perspective part view of a single-row gas cooler,

FIG. 2 shows a longitudinal section through the gas cooler according to FIG. 1, FIG. 3 shows a section along the line III—III in FIG. 2, FIG. 4 shows a second exemplary embodiment of a gas cooler with a step in the cover edge, FIG. 5 shows a longitudinal section through the gas cooler according to FIG. 4, FIG. 6 shows a third exemplary embodiment of a two-row gas cooler with a four-duct header box, and FIG. 7 shows a further perspective view of the gas cooler according to FIG. 6.

Figure 8:
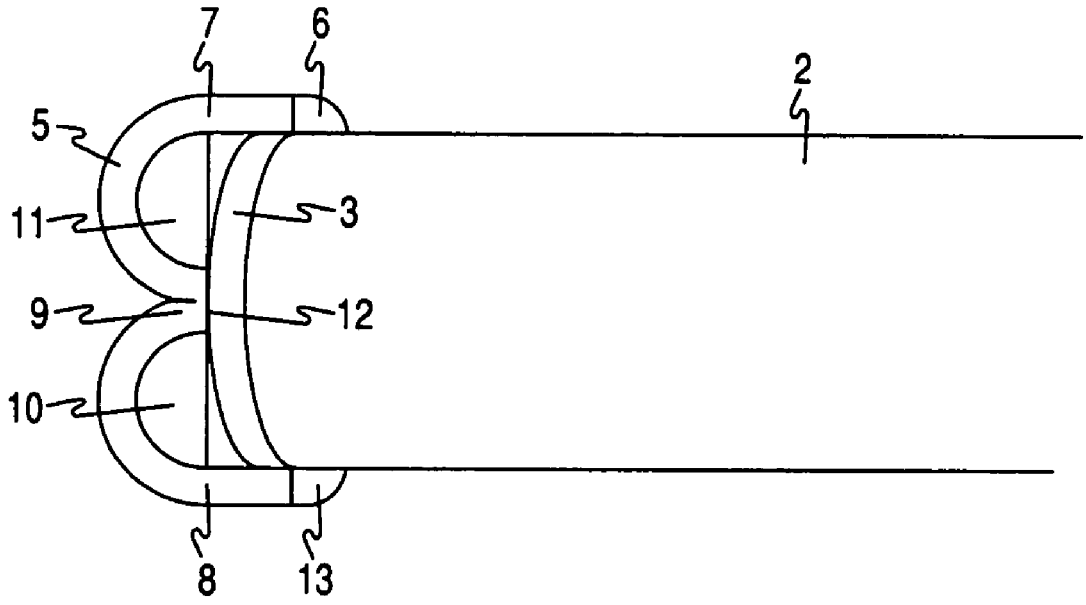

FIG. 8 shows a longitudinal section through a gas cooler with a bottom of convex design.

FIG. 1 shows a part view of a condenser or gas cooler 1, such as may be used preferably in an air-conditioning system of a motor vehicle, said air-conditioning system being operated with the coolant $CO_2$. As is known per se, the gas cooler 1 has a heat exchanger network, of which only flat tubes 2 are partially illustrated here, said flat tubes being received with their tube ends 2*a* by a bottom 3 of a header box 4. Between the flat tubes 2 are located corrugated ribs, not illustrated, for enlarging the air-side heat exchange surface. The header tube 4 consists, furthermore, of a cover 5 of W-shaped or M-shaped design which engages behind the bottom 3 with brackets or tabs 6 arranged at the edge.

The W-shaped or M-shaped cover is designed in such a way that a longitudinal partition is formed such that regions of the cover touch one another and are soldered to one another. A double-walled partition is thus formed.

Instead of the cover, the bottom may also have the partition.

FIG. 2 shows a section through the gas cooler 1 according to FIG. 1, specifically in parallel between two flat tubes 2. Clearly recognizable in this cross section is the W-shape or M-shape of the cover 5 which is bent from a sheet metal strip and which has two outer edge regions 7, 8 and a middle web 9 which is produced as a fold and which forms a longitudinal partition running in the longitudinal direction of the header box 4 and consequently subdivides the header box 4 into two longitudinal ducts 10, 11. The bottom 3 is of concave design, that is to say is curved outward. The middle web 9 has a web back 12 which lies over its full area on the bottom 3 and is soldered to the latter so as to form a tie rod. The bottom 3, which in each case projects somewhat beyond the narrow sides of the flat tubes 2, has tabs 6, 13 engaged behind it in these regions, with the result that a fixing of the cover 5 and bottom 3 is brought about.

FIG. 3 shows a section along the line III—III in FIG. 2, the flat tubes 2 being hatched in a simplified illustration. In actual fact, the flat tubes 2 have a multiduct cross section which is produced by extrusion. The flat tube ends 2*a* are received in corresponding orifices 3*a* of the bottom 3 and project into the interior of the longitudinal ducts 10, 11. In this region around the flat tube ends 2*a*, the longitudinal partition or the middle web 9 is provided with archway-shaped indentations 14, so that its U-shaped gap 15 remains around the flat tube ends 2*a*. By means of this gap 15, on the one hand, coolant can emerge from the flat tubes 2 and, on the other hand, coolant can flow from one longitudinal duct 10 over into the other longitudinal duct 11, or vice versa. The gaps 15 are thus overflow orifices between the two longitudinal ducts 10, 11.

FIG. 4 shows a second exemplary embodiment of a gas cooler 16 with a cover 17 of W-shaped design and with a planar bottom 18.

FIG. 5 shows a longitudinal section through the gas cooler 16 according to FIG. 4. The cover 17 has two edges 19, 20, on the inside of which are integrally formed steps 21, 22 which serve as bearing means for the bottom 18. On the side facing away from the steps 21, 22, the bottom 18 has engaged behind it tabs 23, 24 which project from the edges 19, 20.

FIG. 6 and FIG. 7 show a third exemplary embodiment of a gas cooler 25 with two rows of flat tubes 26, the ends of which are received by a planar bottom 27 of a header box 28. The latter has a cover 29 which is bent and folded from a sheet metal strip and which has the shape of a double W, that is to say three middle webs 30 which subdivide the header box 28 into four longitudinal ducts 31. As already described above, this cover 29 also has steps 32 for the bearing of the bottom 27 which is likewise fixed by means of tabs 33.

By virtue of this multiduct design, a larger volume for the header box 28 is formed and, at the same time, the pressure stability required for the high internal pressures is ensured.

FIG. 8 shows a longitudinal section through a gas cooler with a bottom 3 of convex design. The gas cooler includes flat tubes 2 and a W-shaped or M-shaped cover 5 which is bent from a sheet metal strip. The cover includes two outer edge regions 7, 8 and a middle web 9 that is produced as a fold and which forms a longitudinal partition running in the longitudinal direction of the header box 4 and consequently subdivides the header box into two longitudinal ducts 10, 11. The middle web 9 has a web back 12 which lies over its full area on the bottom 3 and is soldered to the latter so as to form a tie rod. The bottom 3 is of convex design and has a curvature which points inward from outside the header box. The bottom 3, which projects somewhat beyond the narrow sides of the flat tubes 2, has tabs 6, 13 engaged behind it in these regions, fixing the cover 5 and bottom 3.

The invention claimed is:

1. A heat exchanger, comprising:

at least one two-part header box; and a heat exchanger core comprising flat tubes and corrugated fins;

wherein the at least one header tank comprises a bottom and a cover, wherein the bottom includes orifices for reception of ends of the flat tubes, wherein the bottom is connected to the cover in a fluidtight manner, wherein the header tank includes at least one longitudinal partition for forming at least two longitudinal ducts, wherein the cover is designed in such a way that the longitudinal partition is formed by two regions of the cover which are oriented essentially in parallel;

wherein the at least one longitudinal partition has recesses or indentations, into which flat tube ends at least partially engage or project; and wherein free regions are formed between the indentations and the flat tube ends.

2. The heat exchanger as claimed in claim 1, wherein the two regions oriented essentially in parallel touch one another.

3. The heat exchanger as claimed in claim 1, wherein the two regions oriented essentially in parallel are connected to one another.

4. The heat exchanger as claimed in claim 1, wherein the longitudinal partition comprises a bent-round or folded sheet metal wall.

5. The heat exchanger as claimed in claim 1, wherein the longitudinal partition comprises a fold.

6. The heat exchanger as claimed in claim 1, wherein the cover has one, two, three or more partitions.

7. The heat exchanger as claimed in claim 1, wherein the cover engages over the bottom at the edge.

8. The heat exchanger as claimed in claim 1, wherein the bottom engages over the cover at the edge.

9. The heat exchanger as claimed in claim 1, wherein the bottom is of concave design and has a curvature which points outward from inside the header tank.

10. The heat exchanger as claimed in claim 1, wherein the bottom is of convex design and has a curvature which points inward from outside the header tank.

11. The heat exchanger as claimed in claim 1, wherein the cover or the bottom engages behind the bottom or the cover at at least one edge.

12. The heat exchanger as claimed in claim 1, wherein the bottom or the cover is designed with tabs which engage behind the cover or the bottom at the edge.

13. The heat exchanger as claimed in claim 12, wherein the tabs are arranged between the flat tubes.

14. The heat exchanger as claimed in claim 1, wherein the partition has recesses or indentations into which no flat tube ends project.

15. The heat exchanger as claimed in claim 1, wherein the free regions comprise U-shaped gaps.

16. The heat exchanger as claimed in claim 1, wherein the free regions are designed partially as stops for the tubes.

17. The heat exchanger as claimed in claim 1, wherein the edges of the cover or bottom have on the inside steps which run in the longitudinal direction and against which the bottom or cover bears.

18. The heat exchanger as claimed in claim 1, wherein the cover has further longitudinal partitions or individual longitudinal partitions for forming further longitudinal ducts.

19. The heat exchanger as claimed in claim 18, wherein the further longitudinal partitions or individual longitudinal partitions have no recesses or indentations.

20. The heat exchanger as claimed in claim 18, wherein the further longitudinal partitions or individual longitudinal partitions have recesses or indentations which do not serve for the overflow of a fluid.

21. The heat exchanger as claimed in claim 1, wherein the flat tubes are arranged in two or more rows.

22. The heat exchanger as claimed in claim 11, wherein the cover or the bottom engages behind the bottom or the cover at at least two edges.

23. The heat exchanger as claimed in claim 1, wherein the free regions comprise gaps between the indentations and the flat tube ends.

24. The heat exchanger as claimed in claim 3, wherein the two regions oriented essentially in parallel are soldered to one another.

* * * * *